United States Patent [19]

Knape

[11] Patent Number: 4,482,094

[45] Date of Patent: Nov. 13, 1984

[54] ELECTROMAGNETIC UNIT FUEL INJECTOR

[75] Inventor: Richard S. Knape, Grand Rapids, Mich.

[73] Assignee: General Motors Corporation, Detroit, Mich.

[21] Appl. No.: 529,220

[22] Filed: Sep. 6, 1983

[51] Int. Cl.[3] ..... F02M 47/00

[52] U.S. Cl. ..... 239/88; 239/585; 123/446

[58] Field of Search ..... 239/585, 124, 125, 88–91, 239/95; 417/298; 123/446

[56] References Cited

U.S. PATENT DOCUMENTS

| | | | |
|---|---|---|---|
| 2,681,177 | 6/1954 | Hartwell | 417/298 |
| 3,481,542 | 12/1969 | Huber | 239/89 |
| 4,129,253 | 12/1978 | Bader et al. | 239/88 |
| 4,392,612 | 7/1983 | Deckard et al. | 239/88 |
| 4,408,718 | 10/1983 | Wich | 239/585 X |

*Primary Examiner*—Richard E. Gluck

*Attorney, Agent, or Firm*—Arthur N. Krein

[57] ABSTRACT

An electromagnetic unit fuel injector for use in a diesel engine includes a housing with a pump therein defined by an externally actuated plunger reciprocable in a bushing and defining therewith a pump chamber for the discharge of fuel to a spring biased, pressure actuated fuel injection nozzle. The pump chamber is also connected to a fuel chamber via a solenoid actuated, normally open, pressure balanced control valve controlled passage to permit the ingress and egress of fuel. The solenoid and control valve are located concentrically with respect to the plunger. During a pump stroke, the solenoid can be energized to move the valve in position to block flow from the pump chamber to the fuel chamber so as to allow the pressurization of fuel by the pump to effect discharge of fuel from the injection nozzle.

3 Claims, 3 Drawing Figures

ELECTROMAGNETIC UNIT FUEL INJECTOR

This invention relates to unit fuel injectors of the type used to inject fuel into the cylinders of a diesel engine and, in particular, to an electromagnetic unit fuel injector having a solenoid controlled, pressure balanced valve therein located concentrically with respect to the pump plunger of the injector.

DESCRIPTION OF THE PRIOR ART

Unit fuel injectors, of the so-called jerk type, are commonly used to pressure inject liquid fuel into an associate cylinder of a diesel engine. As is well known, such a unit injector includes a pump in the form of a plunger and bushing which is actuated, for example, by an engine driven cam whereby to pressurize fuel to a suitable high pressure so as to effect the unseating of a pressure actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger.

In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect unseating of the injection valve of the associated fuel injection nozzle.

Exemplary embodiments of such electromagnetic unit fuel injectors are disclosed, for example, in U.S. Pat. No. 4,129,253 entitled Electromagnetic Unit Fuel Injector issued Dec. 12, 1978 to Ernest Bader, Jr., John I. Deckard and Dan B. Kuiper and in U.S. Pat. No. 4,392,612 entitled Electromagnetic Unit Fuel Injector issued July 12, 1983, in the names of John I. Deckard and Robert D. Straub.

SUMMARY OF THE INVENTION

The present invention provides an electromagnetic unit fuel injector that includes a pump assembly having a plunger reciprocable in a bushing and operated, for example, by an engine driven cam, with flow from the pump during a pump stroke of the plunger being directed to a fuel injection nozzle assembly of the unit that contains a spring biased, pressure actuated injection valve therein for controlling flow out through the spray tip outlets of the injection nozzles. During the pump stroke, fuel from the pump can also flow through a passage means, containing a normally open, pressure balanced, control valve means mounted concentrically relative to the plunger pump assembly, to a fuel supply chamber. Fuel injection is regulated by the controlled energization of the solenoid actuated pressure balanced valve means during a pump stroke of the plunger to permit pressure intensification of fuel to a value to effect unseating of the injection valve.

It is therefore a primary object of this invention to provide an improved electromagnetic unit fuel injector that contains a concentrically mounted solenoid actuated, pressure balanced, tubular control valve means controlling injection, the arrangement being such that the solenoid need only operate against a fraction of the fluid pressure generated by the plunger for controlling the start and end of injection.

Another object of the invention is to provide an improved electromagnetic unit fuel injector having a solenoid mounted concentric with the pump plunger of the unit so as to actuate a pressure balanced, tubular control valve means incorporated therein that is operable upon the controlled energization of the solenoid to control the pressurization of fuel during a pump stroke and which is thus operative to control the beginning and end of fuel injection.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
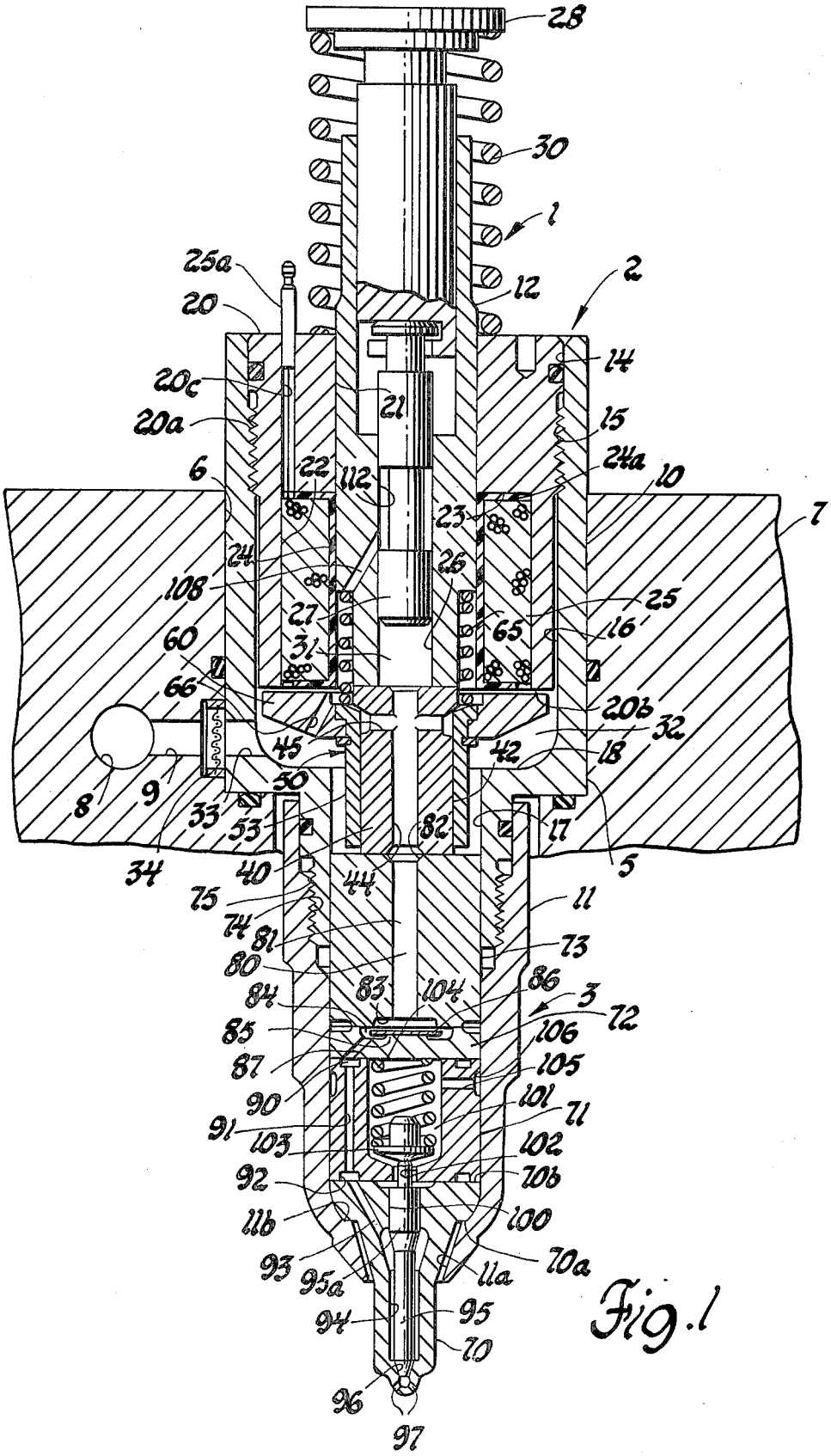
FIG. 1 is an enlarged longitudinal sectional view of an electromagnetic unit fuel injector, in accordance with the invention, with elements of the injector being shown so that the plunger of the pump thereof is positioned as during a pump stroke and with the electromagnetic valve means thereof energized, and with parts of the unit shown in elevation.

Referring now to FIG. 1, there is shown an electromagnetic unit fuel injector constructed in accordance with the invention, that is, in effect, a unit fuel injector-pump assembly, generally designated 1, with a pressure balanced, tubular control valve actuated via a solenoid assembly, generally designated 2, mounted concentric to the injector-pump assembly 1 for controlling fuel discharge from the injection nozzle portion 3 of this assembly in a manner to be described.

In the construction illustrated, the electromagnetic unit fuel injector has an injector housing 5 which includes a main body 10, a nut 11 threaded to the lower end of the body 10 so as to form an extension thereof and, a pump body or bushing 12, all to be described in detail hereinafter.

In the embodiment shown, the body 10 is formed of stepped external configuration whereby it is adapted to be mounted in an injector socket 6 provided for this purpose in the cylinder head 7 of an internal combustion engine, the arrangement being such whereby fuel can be supplied to the electromagnetic unit fuel injector via an internal fuel rail or gallery suitably provided for this purpose in the cylinder head, in a manner known in the art.

As would be conventional, a suitable hold-down clamp, not shown, would be used to retain the electromagnetic unit fuel injector in its associate injector socket 6.

In the construction shown, the body 10 is provided with a stepped cylindrical axial bore therethrough which defines an internal upper wall 14, an upper intermediate internally threaded wall 15, a lower intermediate wall 16 and, a lower wall 17. Walls 15, 16 and 17 are of progressively smaller internal diameters than the internal diameter of wall 14. Walls 16 and 17 are interconnected by a flat shoulder 18.

Now in accordance with a feature of the invention, the bushing 12 of the pump assembly is supported within the body 10 by the tubular pole piece 20 of the solenoid assembly, to which it is suitably fixed. In the construction illustrated, the pole piece 20 is of external stepped configuration and sized so as to be slidably received by the walls 14 and 16 and with the external threads 20*a* of this pole piece threadingly engaged with the internally threaded wall 15.

The pole piece 20, of suitable material such as soft core iron, is provided with a stepped axial bore therethrough so as to define an internal upper wall 21 and a lower wall 22, of an internal diameter greater than that of wall 21, with these walls being interconnected by a flat shoulder 23. A coil bobbin 24, supporting a wound solenoid coil 25, is received by the lower wall 22 so that its upper flange 24*a* abuts against the shoulder 23 and its lower flange is substantially co-planar with the lower working surface 20*b* of the pole piece.

A pair of electrical terminals 25*a* are each connected at one end to the coil 25 and are located to extend upward therefrom out through suitable apertures 20*c* provided for this purpose in the pole piece 20 for connection to a source of electrical power as controlled by an electronic control unit, such as an onboard computer, not shown, receiving signals of various engine operating conditions as well known in the art. Only one such terminal and aperture is shown in FIG. 1.

In the construction illustrated, the bushing 12, for example, of nitrided steel, has its outer peripheral surface sized relative to the upper wall 21 whereby this bushing 12 is fixed to the pole piece 20 by an interference fit, with the lower end of the bushing extending through the central aperture in the bobbin 24 whereby its lower end is located substantially co-planar with the lower flange of the bobbin 24 and with the lower working surface 20*b* of the pole piece.

The bushing 12 is provided with a stepped bore therethrough defining a cylindrical lower wall or pump cylinder 26 of an internal diameter to reciprocably receive a pump plunger 27 and, an upper wall of a larger internal diameter to slidably receive a plunger actuator follower 28. The follower 28 extends out one end of the bushing 12 whereby it and the plunger 27, connected thereto, are adapted to be reciprocated by an engine driven cam or rocker, not shown, and by a plunger return spring 30 in a conventional manner. As would be conventional, a stop pin, not shown, can be provided so as to engage in an axial groove, not shown, in the follower 28 to limit upward travel of the follower.

The pump plunger 27 forms with the pump bushing 12 a pump chamber 31 located at the lower end of the bushing with reference to FIG. 1.

As illustrated, the axial extent of the pole piece 20, coil bobbin 24 and the axial position of the bushing 12 in the pole piece 20 are selected whereby the lower surfaces of these elements are substantially co-planar and axially spaced a predetermined distance from the internal shoulder 18 of the body 10 to define therewith a fuel chamber 32.

The main body 10 is provided with one or more radial fuel ports or passages 33 whereby fuel, as from a fuel tank via a supply pump and conduit, can be supplied at a predetermined relative low supply pressure to the fuel chamber 32 and whereby fuel from this fuel chamber can be drained back to a correspondingly low pressure fuel area.

In the embodiment illustrated, only one such radial fuel passage 33 is provided to serve for both the ingress and egress of fuel to the fuel chamber 32.

For this purpose, with reference to the particular construction shown, the cylinder head 7 is provided with a longitudinally extending supply/drain passage or fuel rail 8 that is in flow communication via a passage 9 with the fuel passage 33. As would be conventional, a suitable fuel filter 34 is operatively positioned to filter the fuel at a location upstream of the fuel chamber 32, in terms of supply fuel flow direction.

Alternatively, as is well known in the mechanical unit fuel injector art, at least two such fuel passages 33 oppositively located with respect to each other can be used, if desired, to permit for the continuous flow of fuel through the fuel chamber 32 of the subject injector during engine operation. Also, as is well known, either a pressure regulator or a flow orifice, not shown, would be associated with the supply/drain conduit 8 or with a separate drain conduit, if used, whereby to maintain the pressure in such conduit at the predetermined relatively low supply pressure.

Now in accordance with a feature of the invention, a tubular valve seat member 40, of stepped external configuration, is suitably secured, as by welding, to the lower end of the bushing 12 so as to partly enclose the pump chamber 31. The valve seat member 40, at its upper end is provided with a flange portion 40*a* having an external annular valve seat 41 formed thereon, the reduced diameter lower end 42 of this valve seat member 40 being provided with an annular groove 43 located next adjacent to the valve seat 41. The valve seat member 40 is provided with an axial passage 44 therethrough which is in flow communication at its upper end with the pump chamber 31 and it is also provided with one or more radial ports or passages 45 that intersect the axial passage 44 and open into a chamber that is, in effect, defined by the annular groove 43.

Figure 2:
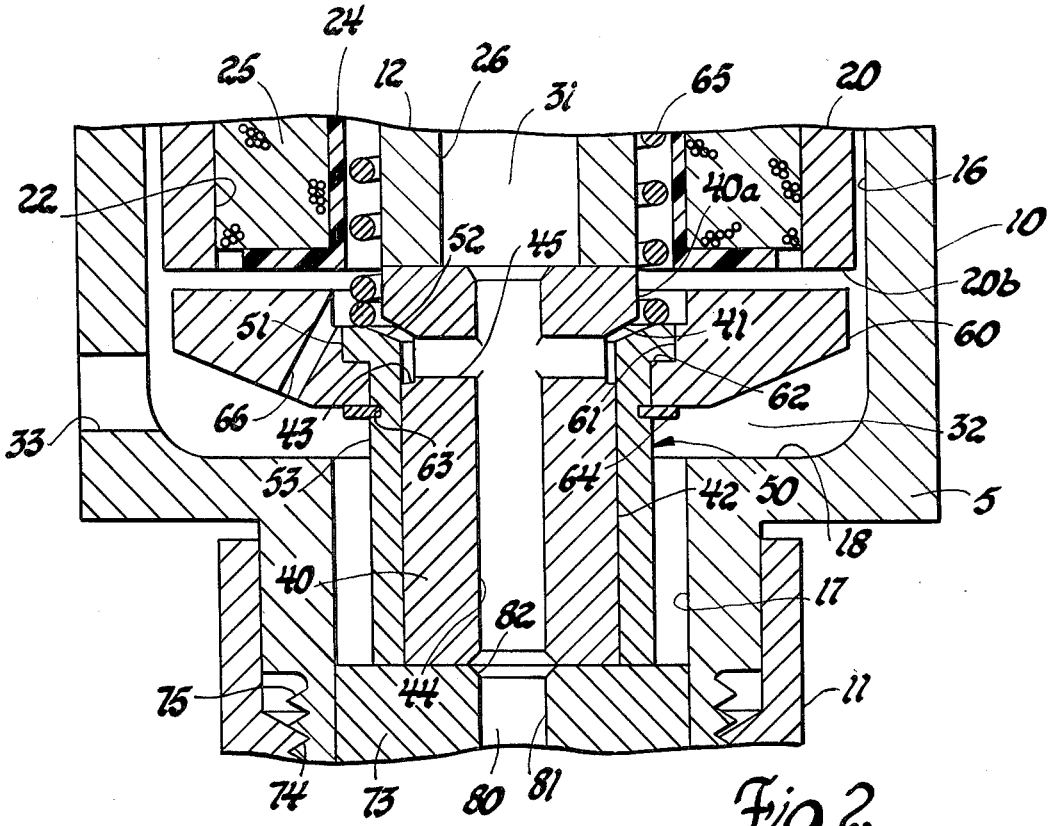
FIG. 2 is a further enlarged sectional view of the control valve, per se, of the electromagnetic unit fuel injector of FIG. 1, the control valve being shown in the valve open position; and, FIG. 3 is an enlarged sectional view similar to FIG. 2, but showing the control valve in the valve closed position.
Figure 3:
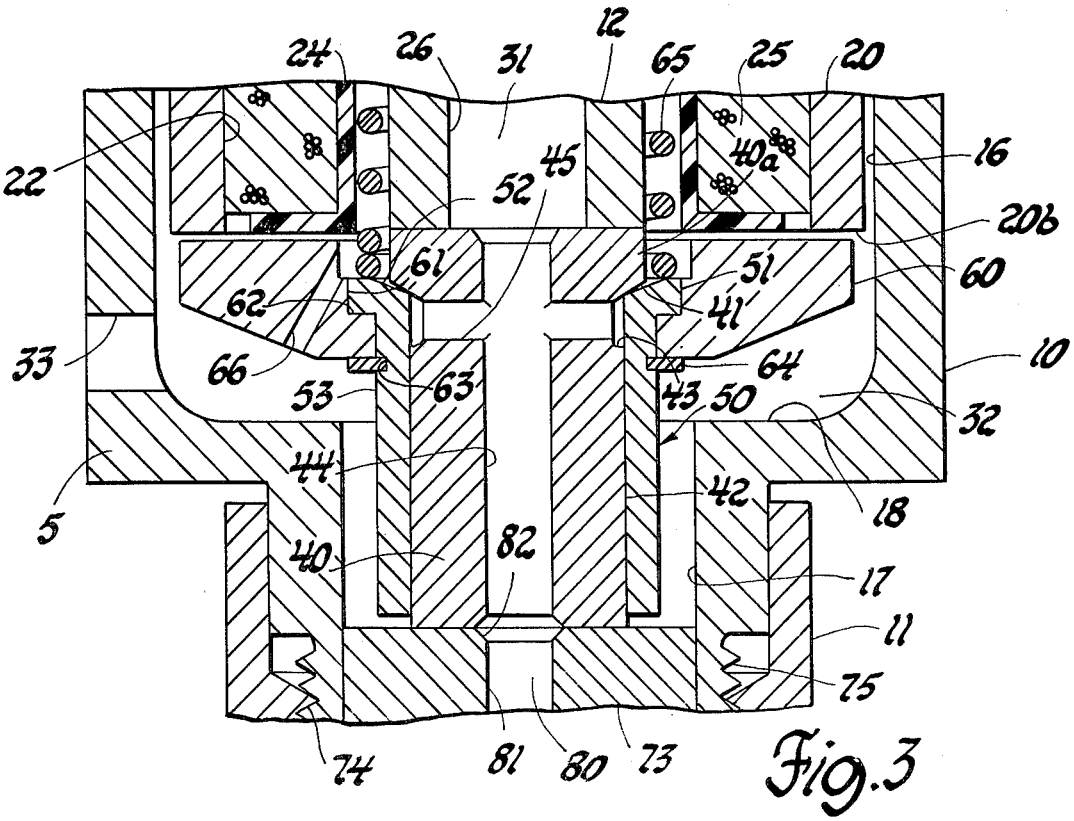

A tubular valve 50 is operatively associated with the valve seat member 40 and this valve 50 includes an upper annular flange portion 51 having an annular valve seating surface 52 thereon and, a lower sleeve portion 53 of an internal diameter so as to slidably and sealingly encircle the lower end portion 42 of the valve seat member 40 whereby the valve 50 can be reciprocated so that its valve seating surface 52 can be moved into and out of seating engagement with the valve seat 41, the valve open and valve closed positions being shown in FIGS. 2 and 3, respectively.

As best seen with reference to FIGS. 2 and 3, the angle of the valve seat 41 and the angle of the valve seating surface 52 are preselected relative to each other so that in the valve closed position, the position shown in FIG. 3, the annular line contact of these mating valve surfaces 41, 52 substantially coincides with the internal diameter of the lower sleeve portion 53 of the valve 50 for a purpose to be described in detail hereinafter.

The valve 50 is actuated by means of a washer-like, disc armature 60 that is suitably fixed to the valve for movement therewith. For this purpose, in the construction shown, the armature 60 is provided with a stepped bore to define an annular wall 61 and flat shoulder 62 to receive the flange 51 end of the valve, while the lower sleeve portion 53 of the valve 50 is provided with an annular groove 63 to receive a retainer ring 64 whereby the inner portion of the armature 60 is sandwiched between this retainer ring 64 and the shoulder 62 of the valve 50.

A coil spring 65 encircling the lower reduced diameter end of the bushing 12 operatively abuts at one end against a shoulder of the bushing 12 and, at its other end, abuts against the upper surface of the valve 50 outboard of valve seat 52 to normally bias the valve in an axial direction toward the valve open position, the position shown in FIG. 2.

As shown in FIGS. 1 and 3, the axial extent of the valve seat member 40 and the combined axial extent of the armature 60 and valve 50 is such that when the valve 50 is in its valve closed position, a fixed minimum air gap, as desired, exists between the opposed working surfaces of the pole piece 20 and armature 60. The lower face of the valve 50 is then axially spaced from the lower end surface of the valve seat member 40, a predetermined distance, so as to permit for the desired valve opening travel. The full valve 50 opening position is shown in FIG. 2.

Preferably, as shown, armature 60 is provided with at least one inclined passage 66 extending from its lower surface so as to open at its opposite end radially inward of the working face of the armature 60, that is, it opens through wall 61.

In the arrangement shown, during a suction stroke of plunger 27 and with the valve 50 in its normally open position, as biased thereto by spring 65, fuel in fuel chamber 32 can flow through the then working air gap between opposed working surfaces of the pole piece 20 and armature 60 and also via passage 66 so as to then flow through the annular gap between the then spaced apart valve seating surfaces 41, 52 into the chamber defined by annular groove 43 and then, via radial ports 45, up through axial passage 44 into the pump chamber 31.

During a pump stroke of plunger 27, and with the solenoid coil 25 deenergized, fuel flow would be in the reverse direction, that is, fuel can then flow from the pump chamber 31 to the fuel chamber 32 in the reverse manner described hereinabove.

As previously described, the nut 11 is threaded onto the lower end of the body 10 to form an extension thereof adapted to house the fuel injector portion of the unit fuel injector.

For this purpose and as shown in FIG. 1, nut 11 has an opening 11*a* at its lower end through which extends the lower end of a combined injector valve body or spray tip 70, hereinafter referred to as the spray tip, of a conventional type fuel injection nozzle assembly.

As shown, the spray tip 70 is enlarged at its upper end to provide a shoulder 70*a* which seats on an internal shoulder 11*b* provided by the through counterbore in nut 11. Between the spray tip 70 and the lower end of the valve seat member 40 in body 10 there is positioned, in sequence starting from the spray tip, a rate spring cage 71, a spring retainer 72 and a director cage 73, these elements being formed, in the construction illustrated, as separate elements for ease of manufacturing and assembly. Nut 11 is provided with internal threads 74 for mating engagement with the external threads 75 at the lower end of body 10. The threaded connection of the nut 11 to body 10 holds the spray tip 70, rate spring cage 71, spring retainer 72 and director cage 73 clamped and stacked end-to-end between the upper face 70*b* of the spray tip and the bottom face of the valve seat member 40. All of these above-described elements have lapped mating surfaces whereby they are held in pressure sealed relation to each other.

During a pump stroke of plunger 27, fuel is adapted to be discharged from pump chamber 31 through the axial passage 44 in the valve seat element 40 into the inlet end of a discharge passage means 80 to be described next hereinafter.

An upper part of this discharge passage means 80, with reference to FIG. 1, includes a vertical passage 81 extending from an upper recess 82 through director cage 73 for flow communication with an annular recess 83 provided in the lower surface of director cage 73.

As shown in FIG. 1, the spring retainer 72 is provided with an enlarged chamber 84 formed therein so as to face the recess 83 and, projecting upwardly from the bottom of the chamber 84 is a protuberance 85 which forms a stop for a circular flat disc check valve 86. The chamber 84 extends laterally beyond the extremities of the opening defining recess 83 whereby the lower end surface of the director cage 73 will form a seat for the check valve 86 when in a position to close the opening defined by recess 83.

At least one inclined passage 87 is also provided in the spring retainer 72 to connect the chamber 84 with an annular groove 90 in the upper end of spring cage 71. This groove 90 is connected with a similar annular groove 92 on the bottom face of the spring cage 71 by a longitudinal passage 91 through the spring cage. The lower groove 92 is, in turn, connected by at least one inclined passage 93 to a central passage 94 surrounding a needle valve 95 movably positioned within the spray tip 70. At the lower end of passage 94 is an outlet for fuel delivery with an encircling tapered annular seat 96 for the needle valve 95 and, below the valve seat, are connecting spray orifices 97 in the lower end of the spray tip 70.

The upper end of spray tip 70 is provided with a bore 100 for guiding opening and closing movements of the needle valve 95. The piston portion 95*a* of the needle valve slidably fits this bore 100 and has its lower end exposed to fuel pressure in passage 94 and its upper end exposed to fuel pressure in the spring chamber 101 via an opening 102, both being formed in spring cage 71. A reduced diameter upper end portion of the needle valve 95 extends through the central opening 102 in the spring cage and abuts a spring seat 103. Compressed between the spring seat 103 and spring retainer 72 is a coil spring 104 which normally biases the needle valve 95 to its closed position shown.

In order to prevent any tendency of fuel pressure to build up in the spring chamber 101, this chamber, as shown in FIG. 1, is vented through a radial port passage 105 to an annular groove 106 provided on the outer peripheral surface of spring cage 71. While a close fit exists between the nut 11 and the spring cage 71, spring retainer 72 and director cage 73, there is sufficient diametral clearance between these parts and between the director cage 73 and wall 17 of body 10 for the venting of fuel back to a relatively low pressure area, such as in the fuel chamber 32.

For a similar purpose, an inclined passage 108 in the bushing 12 extends from the wall of cylinder 26, at a location traversed by the annular groove 112 in plunger 27 for flow communication with fuel chamber 32.

FUNCTIONAL DESCRIPTION

Referring now in particular to FIG. 1, during engine operation, fuel from a fuel tank, not shown, is supplied at a predetermined supply pressure by a pump, not shown, to the subject electromagnetic unit fuel injector as through the fuel rail 8 and passage 9. Fuel as thus delivered flows through the fuel passage 33 into the fuel chamber 32.

When the solenoid coil 25 of the solenoid assembly 2 is de-energized, the spring 65 will be operative to hold open the valve 50 relative to the valve seat 41. At the same time the armature 60, which is connected to valve 50, is also moved downward, with reference to FIGS. 1 and 3, relative to the pole piece 20 whereby to establish a predetermined working air gap between the opposed working surfaces of these elements as shown in FIG. 2.

With the valve 50 in its open position, fuel can flow from the fuel chamber 32 into the pump chamber 31 in the manner described hereinabove. Thus during a suction stroke of the plunger 27, the pump chamber will be resupplied with fuel. At the same time, fuel will be present in the discharge passage means 80 used to supply fuel to the injection nozzle assembly.

Thereafter, as the follower 28 is driven downward, as by a cam or cam actuated rocker arm, to effect downward movement of the plunger 27, this downward movement of the plunger will cause fuel to be displaced from the pump chamber 31 and will cause the pressure of the fuel in this chamber and adjacent passages connected thereto to increase. However with the solenoid coil 25 still deenergized, this pressure can only rise to a level that is a predetermined amount less than the "pop" pressure required to lift the needle valve 95 against the force of its associate return spring 104.

During this period of time, the fuel displaced from the pump chamber 31 can flow via the passages previously described hereinabove back into the fuel chamber 32 and then from this chamber the fuel can be discharged via the fuel passage 33 for return, for example, via the fuel rail 8 back to the fuel tank containing fuel at substantially atmospheric pressure. As is conventional in the diesel fuel injection art, a number of electromagnetic unit fuel injectors can be connected in parallel to a common supply drain or drain conduit, not shown, which normally contains, for example, an orifice passage therein, not shown, used to control the rate of fuel flow through the drain conduit whereby to permit fuel pressure at a predetermined supply pressure to be maintained in each of the injectors.

Thereafter, during the continued downward stroke of the plunger 27, an electrical (current) pulse of finite characteristic and duration (time relative for example to the top dead center of the associate engine piston position with respect to the cam shaft and rocker arm linkage) applied through suitable electrical conductors to the solenoid coil 25 produces an electromagnetic field attracting the armature 60 to effect its movement toward the pole piece 20. This upward movement, with reference to FIG. 2, of the armature 60, as coupled to the valve 50, will effect seating of the valve 50 against its associate valve seat 41, the position of these elements shown in FIGS. 1 and 3. As this occurs, the drainage of fuel, as described hereinabove, will no longer occur and this then permits the plunger 27 to increase the pressure of fuel to a "pop" pressure level to effect unseating of the needle valve 95. This then permits the injection of fuel out through the spray orifices 97. Normally, the injection pressure increases during further continued downward movement of the plunger.

Ending the current pulse causes the electromagnetic field to collapse, allowing the spring 65 to again open the valve 50 and to also move the armature 60 to its lowered position. Opening of the valve 50 again permits fuel flow via the passages previously described into the fuel chamber 32. This drainage flow of fuel thus releases the system pressure in the discharge passage means 80 whereby the spring 104 can again effect closure of the needle valve 95.

While the invention has been described with reference to a particular embodiment disclosed herein, it is not confined to the details set forth since it is apparent that various modifications can be made by those skilled in the art without departing from the scope of the invention. This application is therefore intended to cover such modifications or changes as may come within the purposes of the invention as defined by the following claims.

The embodiments of the invention in which an exclusive property or privilege is claimed are defined as follows:

1. An electromagnetic unit fuel injector comprising a housing means having a fuel passage means connectable to a source of fuel for the ingress and egress of fuel at a suitable supply pressure; a pump cylinder means in said housing means; an externally actuated plunger reciprocable in said cylinder means to define therewith a pump chamber; a cylindrical valve seat member fixed to said pump cylinder means at said pump chamber end thereof so as to define with said housing means a fuel chamber in communication with said fuel passage means, said valve seat member having an annular valve seat on its outer peripheral surface next adjacent to said pump cylinder means and an annular groove adjacent to said valve seat, an axial passage therethrough in communication at one end with said pump chamber and, at least one radial port positioned to effect flow between said axial passage and said annular groove; said housing means including a valve body having a spray outlet at one end thereof for the discharge of fuel; an injection valve means movable in said valve body to control flow to said spray outlet; a discharge passage means effecting flow communication between said spray outlet and the opposite end of said axial passage; a tubular valve with an annular valve seat surface thereon encircling said valve seat member for axial movement between a valve open position and a valved closed position relative to said valve seat whereby to control flow between said fuel chamber and said annular groove; and, a solenoid means operatively positioned in said housing means, said solenoid means including a pole piece encircling said pump cylinder means, an armature disc fixed to said tubular valve for movement therewith and, a spring means operatively associated with said tubular valve to normally bias it to said open position.

2. An electromagnetic unit fuel injector comprising a housing means having a fuel passage means connectable to a source of fuel for the ingress and egress of fuel at a suitable supply pressure; a solenoid means in one end of said housing means a pump cylinder means mounted axially in said solenoid means; an externally actuated plunger reciprocable in said cylinder means to define therewith a pump chamber; a cylindrical valve seat member fixed to said pump cylinder means at said pump chamber end thereof so as to define with said housing means and one end of said solenoid means a fuel chamber in communication with said fuel passage means, said valve seat member having an annular valve seat on its outer peripheral surface next adjacent to said pump cylinder means and an annular groove adjacent to said valve seat, an axial passage therethrough in communication at one end with said pump chamber and, at least one radial port positioned to effect flow between said axial passage and said annular groove; said housing means including a valve body having a spring biased valve controlled spray outlet at one end thereof for the discharge of fuel; a discharge passage means effecting flow communication between said spray outlet and the opposite end of said axial passage; a tubular valve with an annular valve seat surface thereon encircling said valve seat member for axial movement between a valve open position and a valve closed position relative to said valve seat whereby to control flow between said fuel chamber and said annular groove; and, an armature disc fixed to said tubular valve for movement therewith relative to said solenoid means; and, a spring means operatively associated with said tubular valve to normally bias it to said open position.

3. An electromagnetic unit fuel injector comprising a housing means having a fuel passage means connectable to a source of fuel for the ingress and egress of fuel at a suitable supply pressure; a pump cylinder means and a solenoid means in said housing means said solenoid means including a pole piece, bobbin and solenoid coil positioned so as to encircle a portion of said pump cylinder means within said housing means; an externally actuated plunger reciprocable in said cylinder means to define therewith a pump chamber; a cylindrical valve seat member fixed to said pump cylinder means at said pump chamber end thereof so as to define with said housing means and said solenoid means a fuel chamber in communication with said fuel passage means, said valve seat member having an annular valve seat on its outer peripheral surface next adjacent to said pump cylinder means and an annular groove next adjacent to said valve seat, an axial passage therethrough in communication at one end with said pump chamber and, at least one radial port positioned to effect flow between said axial passage and said annular groove; said housing means including a valve body having a spray outlet at one end thereof for the discharge of fuel with an injection valve means to control flow to said spray outlet; a discharge passage means effecting flow communication between said spray outlet and the opposite end of said axial passage; a tubular valve with an annular valve seat surface thereon encircling said valve seat member for axial movement between a valve open position and a valve closed position relative to said valve seat whereby to control flow between said fuel chamber and said annular groove; and, said solenoid means further including an armature means fixed to said tubular valve for movement therewith within said fuel chamber relative to said pole piece; and, a spring means operatively associated with said tubular valve to normally bias said tubular valve to said open position.

* * * * *